US007665882B1

(12) United States Patent
Wang

(10) Patent No.: US 7,665,882 B1
(45) Date of Patent: Feb. 23, 2010

(54) LAMP BULB PROVIDED WITH A LAMP BURNER SWITCH

(75) Inventor: Robert Wang, Taoyuan County (TW)

(73) Assignee: Ceramate Technical Co., Ltd, Taoyuan County (TW)

( * ) Notice: Subject to any disclaimer, the term of this patent is extended or adjusted under 35 U.S.C. 154(b) by 0 days.

(21) Appl. No.: 12/277,971

(22) Filed: Nov. 25, 2008

(51) Int. Cl.
*F21V 33/00* (2006.01)

(52) U.S. Cl. ..... 362/650; 362/96; 362/253; 362/643

(58) Field of Classification Search ..... 362/96, 362/101, 253, 643
See application file for complete search history.

(56) References Cited

U.S. PATENT DOCUMENTS 7,419,281 B2 * 9/2008 Porchia et al. ..... 362/253
7,476,002 B2 * 1/2009 Wolf et al. ..... 362/231
7,484,860 B2 * 2/2009 Demarest et al. ..... 362/253
2002/0075676 A1 * 6/2002 Jones ..... 362/226
2006/0067076 A1 * 3/2006 Shiang et al. ..... 362/288
2006/0146527 A1 * 7/2006 VanderSchuit ..... 362/228

* cited by examiner

*Primary Examiner*—Anabel M Ton
(74) *Attorney, Agent, or Firm*—Ming Chow; Sinorica, LLC

(57) ABSTRACT

A lamp bulb provided with a lamp burner switch according to this invention comprises a plurality of LEDs. The LEDs are provided on a substrate and further connected to a lamp burner. Each of the LEDs has a first pin and a second pin that is connected to the lamp burner. A switch device is provided passing through the crest of lamp burner at a side opposite to the LED, and one terminal of the switch device is connected to a lamp socket; the other terminal is properly kept at an interval from the first pin of LED, and the switch device is pushed contact the first pin. Further, the switch device is connected to a power unit that is next connected to the lamp burner. Thus, the electric power of power unit may be applied to continuously illuminate for a determined period of time of power outage.

4 Claims, 7 Drawing Sheets

LAMP BULB PROVIDED WITH A LAMP BURNER SWITCH

BACKGROUND OF THE INVENTION

1. Field of the Invention

This invention relates to a lamp bulb provided with a lamp burner switch.

2. Description of the Prior Art

With reference to FIG. 1 as a partial 3D view of a conventional lamp bulb, the conventional lamp bulb comprises a lamp housing 1 and a lamp burner 2. The lamp housing 1 is a transparent housing connected to the lamp burner 2. The lamp burner 2 is further installed in and connected to a lamp socket (not shown). At the time of power failure, the conventional cannot work and illuminate; thus, people might trip over or injure themselves by bumping. In order to solve the defect, a rechargeable lamp bulb is invented.

With reference to FIG. 2 as a 3D view of the conventional rechargeable lamp bulb disclosed in Taiwan Patent No. M308359, the structure comprises a lamp body 3. The top side and bottom side of lamp body 3 is formed respectively with a lamp bulb burner 4 and a joint portion 5 that are publicly defined, and several secondary cells 6 and a PCB 7 may be provided inside the lamp body 3. On the joint portion 5, several light-emitting diodes (LEDs) 8 are provided. Further, a 3-segment switch 9 is provided on the surface of lamp body 3 to control the circuit operation in the PCB 7. The 3 segments of switch 9 are segment 1 for illumination when no power failure occurs, segment 2 that works at the time of power failure, and segment 3 that works for charging. However, during power outage, the structure may use the second cell 6 provided inside to supply power to the light-emitting part 8 for illumination without interruption. The switch 9 must be used to manually switch the 3 segments, which is quite inconvenient. Thus, improvement of the conventional lamp is necessarily made.

Consequently, because of the technical defects of described above, the applicant keeps on carving unflaggingly through wholehearted experience and research to develop the present invention, which can effectively improve the defects described above.

SUMMARY OF THE INVENTION

A lamp bulb provided with a lamp burner switch according to this invention comprises a plurality of LEDs. The LEDs are provided on a substrate and further connected to a lamp burner. Each of the LEDs has a first pin and a second pin that is connected to the lamp burner. A switch device is provided passing through the crest of lamp burner at a side opposite to the LED, and one terminal of the switch device is connected to a lamp socket; the other terminal is properly kept at an interval from the first pin of LED, and the switch device is pushed to stretch towards a chamber and contact the first pin, thereby a turn-on loop being formed. Further, the switch device is connected to a power unit that is next connected to the lamp burner. Thus, during power outage, the lamp may continuously light up for effect of the illumination. Next, the lamp bulb may be removed and the switch device is pushed to connect to the first pin, and the electric power of power unit is applied to illuminate for a determined period of time of power outage.

DETAILED DESCRIPTION OF THE PREFERRED EMBODIMENTS

Now, the present invention will be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
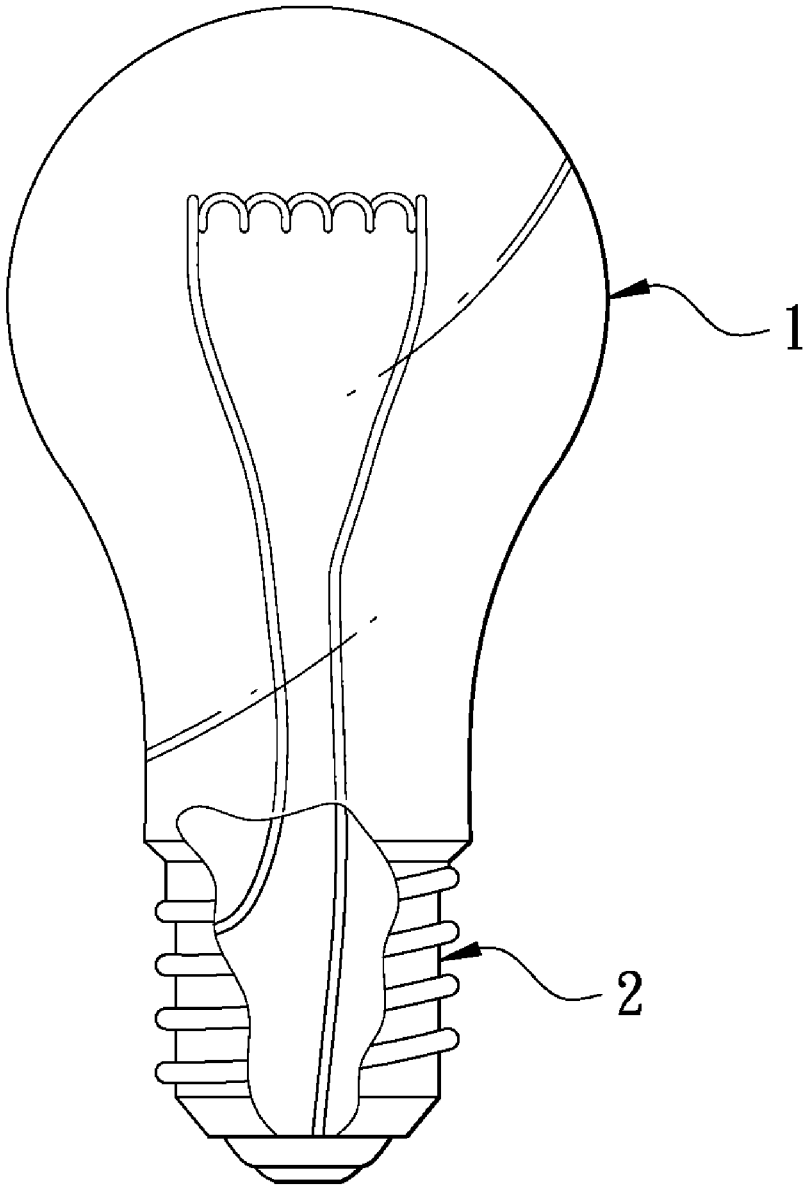
FIG. 1 PRIOR ART
FIG. 1 is a partial 3D view of a conventional lamp bulb.
Figure 2:
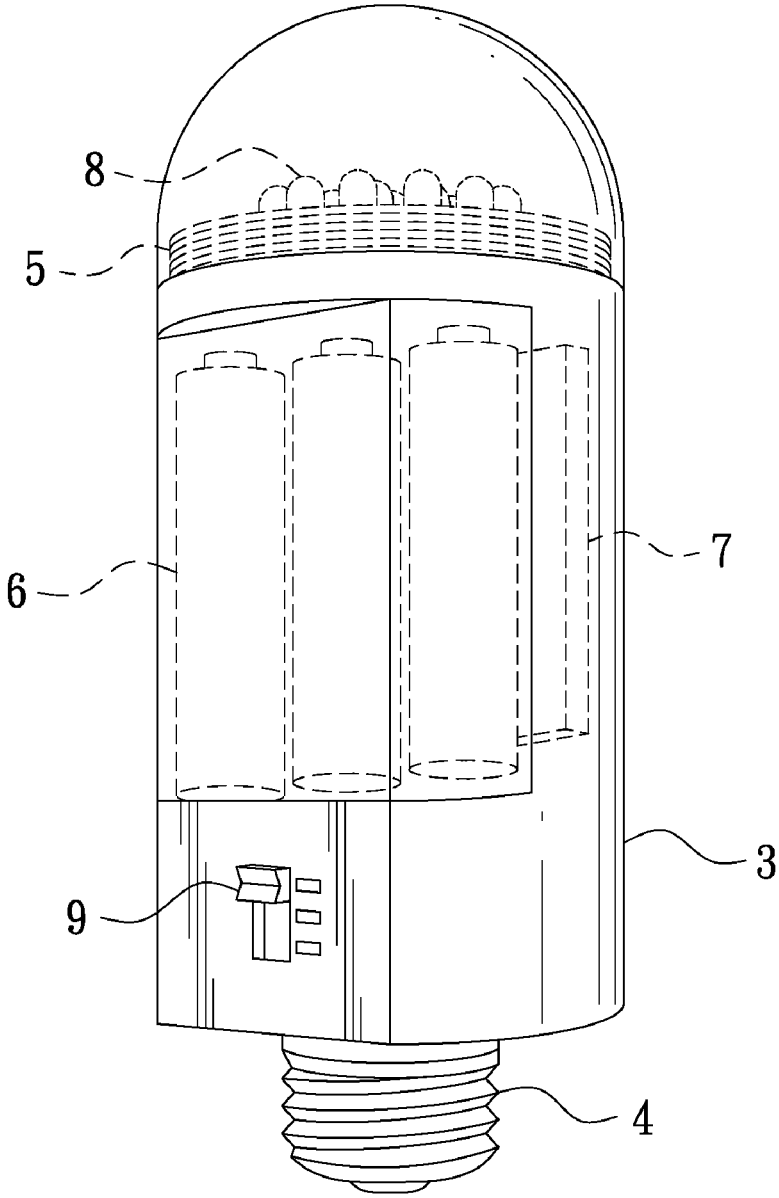
FIG. 2 PRIOR ART
FIG. 2 is a 3D view of a conventional rechargeable lamp bulb.
Figure 3:
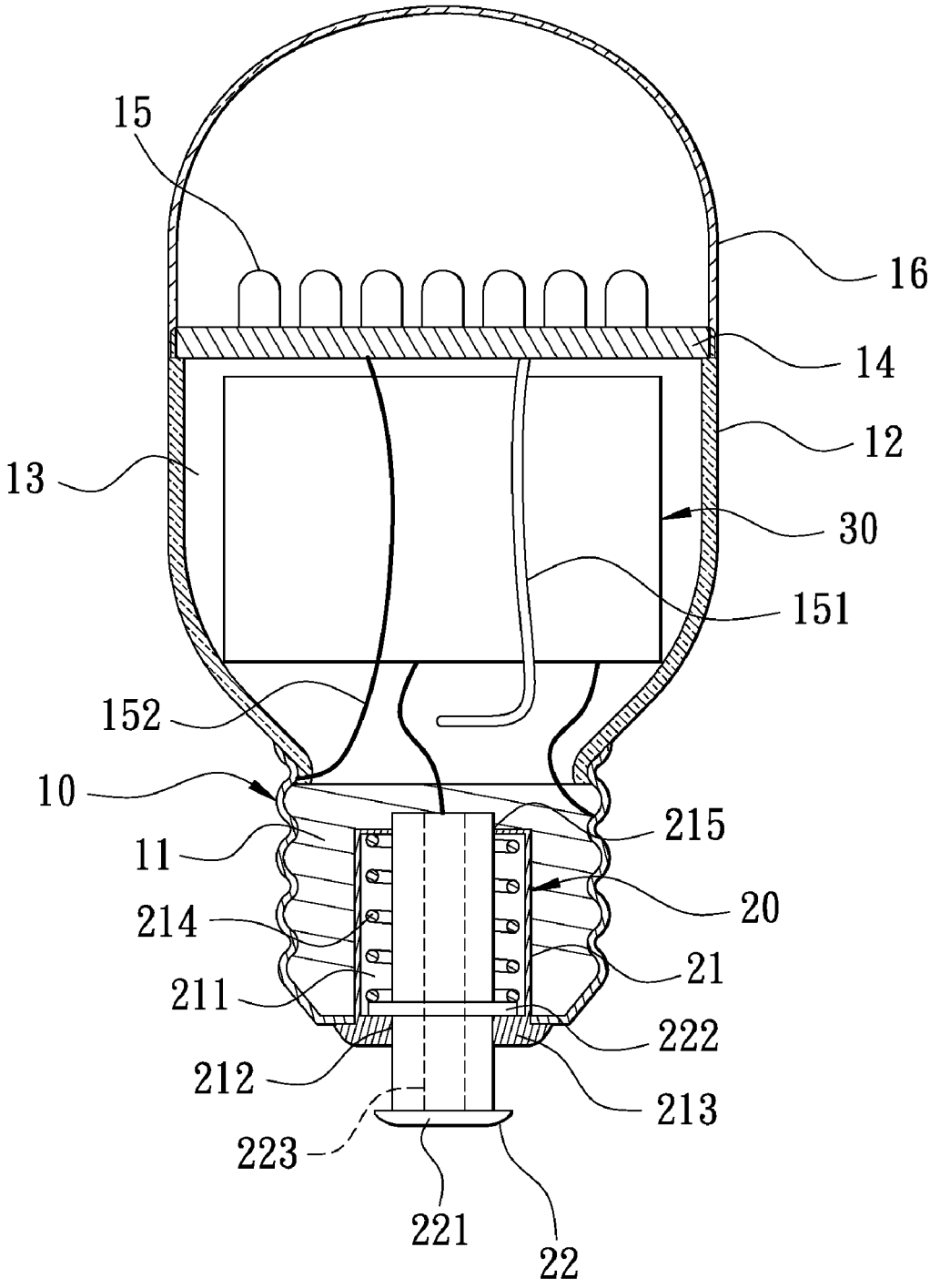
FIG. 3 is a sectional view of a lamp bulb according to this invention.

With reference to FIG. 3 as a sectional view, a lamp bulb according to this invention comprises a lamp burner 10, a switch device 20, and a power unit 30.

A chamber 11 is formed in the lamp burner 10. A joint mask 12 that crooks stretches upwards along the lamp burner 10. A container portion 13 that communicates with the chamber 11 is formed in the joint mask 12. Further, a substrate 14 is fixed onto a mouth above the container portion 13. In a preferred embodiment of this invention, the substrate 14 is a round board. A plurality of LEDs 15 are provided on the substrate 14 and a lamp cap 16 is provided to cover the substrate 14 and wrap around the LED 15. Further, each of the LEDs 15 is provided in the container portion 13 and has a first pin 151 and a second pin 152 that is connected to the lamp burner 10.

The switch device 20 is provided passing through the container portion 11 from the crest of lamp burner 10 at a side opposite to the LED 15, and properly kept at an interval from the first pin 151 of LED 15. In the preferred embodiment of this invention, the switch device 20 comprises a recovery unit 21 and a push unit 22.

The recovery unit 21 passes through the chamber 11 from the crest of lamp burner 10 and is a cylinder and is provided with a room 211 where a mouth 212 is defined. A wedge flange 213 is provided in a radial direction around the mouth 212. The wedge flange 213 is wedged outside the lamp burner 10. An elastic part 214 is further provided in the room 211. In the preferred embodiment of this invention, the elastic part 214 is a compression spring and is wedged between the wedge flange 213 and the room 211. A thru hole 215 is formed at the other side of the mouth 212 opposite to the recovery unit 21.

The push unit 22 passes through the room 211 from the mouth 212 and through the thru hole 215. Further, the push unit 22 is a tube and its top is formed in a radial direction with a push portion 221. The push portion 221 is wedged to the wedge flange 213. Next, a flange 222 that is arranged in the room 211 is formed on the outer circumferential wall of push unit 22. The flange 222 is formed in and kept close to the top of elastic part 214. An electrically conductive portion 223 is vertically formed in the center of push unit 22. The electrically conductive portion 223 is properly kept at an interval from the first pin 151 of LED 15.

Figure 4:
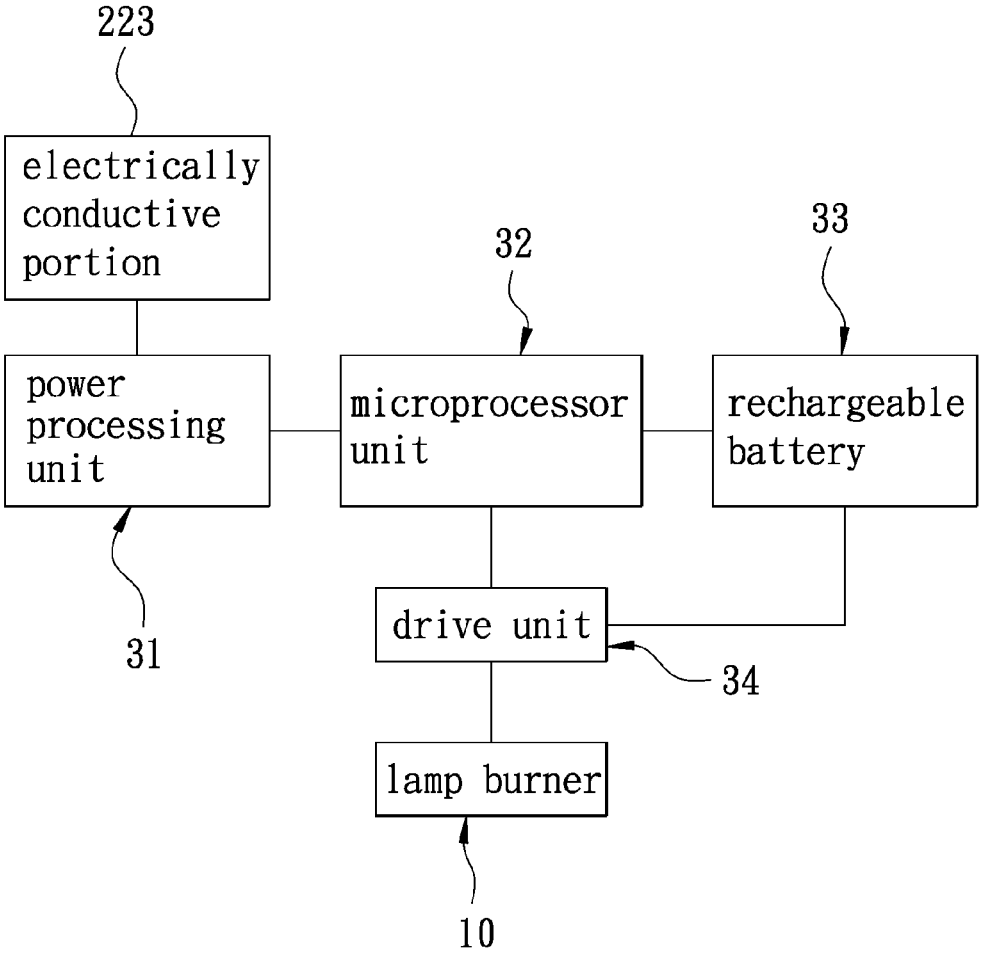
FIG. 4 is a block diagram of the circuit of a power unit according to this invention.

With synchronous reference to FIG. 4, the power unit 30 is provided in the chamber 11 of lamp burner 10, in which one terminal of the unit 30 is connected to the lamp burner 10 and the other terminal is connected to the electrically conductive portion 223 of push unit 22. The power unit 30 further comprises a power processing unit 31, a microprocessor unit 32, a rechargeable battery 33, and a drive unit 34. One terminal of the power processing unit 31 is connected to the electrically conductive portion 223, while the other terminal is connected to the microprocessor unit 32. The microprocessor unit 32 is connected to the rechargeable battery 33 and the drive unit 34, respectively. Besides, the rechargeable battery 33 is also connected to the drive unit 34. The drive unit 34 is further connected to the lamp burner 10.

Figure 5:
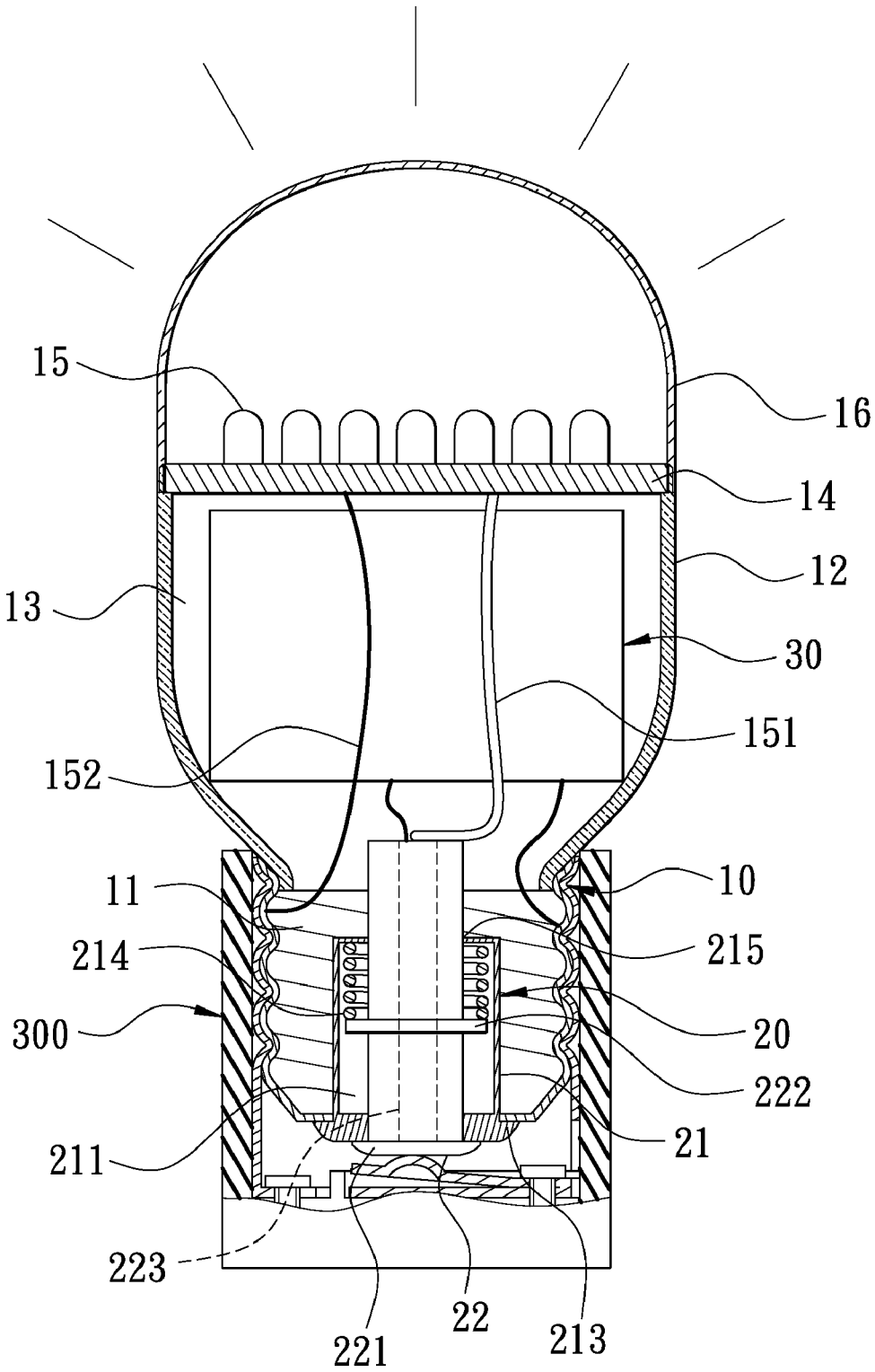
FIG. 5 is a schematic view illustrating a service state of the lamp bulb according to this invention.

Refer to FIGS. 4 and 5 respectively shown as a block diagram of the circuit of a power unit according to this invention and as a service state of a lamp bulb according to this invention. When the LED 15 is installed on a lamp socket 300, because contacting the lamp socket 300, the push portion 221 pushes the push unit 22 to axially stretch towards the lamp burner 10. One terminal of the electrically conductive portion 223 is connected to the lamp socket 300, the other terminal contacts the first pin 151, and thus a turn-on loop is formed to make the LED 15 light up. Further, being subject to the loop, the power unit 30 starts to work. The power processing unit 31 may receive the power supplied from the lamp socket 300 connected to the electrically conductive portion 223 and convert it into DC power. The microprocessor unit 32 detects whether the power processing unit 31 supplies power; when the power is detected, the microprocessor unit 32 charges the rechargeable battery 33 with the power and monitors the power level of rechargeable battery 33 to prevent the power of battery 33 from being consumed and wasted owing to the repeated charging. Contrarily, when the microprocessor unit detects no power supplied by the power processing unit 31, the microprocessor unit 42 turn ON the drive unit 34, and when the electrically conductive portion 223 is connected to the first pin 151, the rechargeable battery 34 is used to drive the LED 15 to light up.

Figure 6:
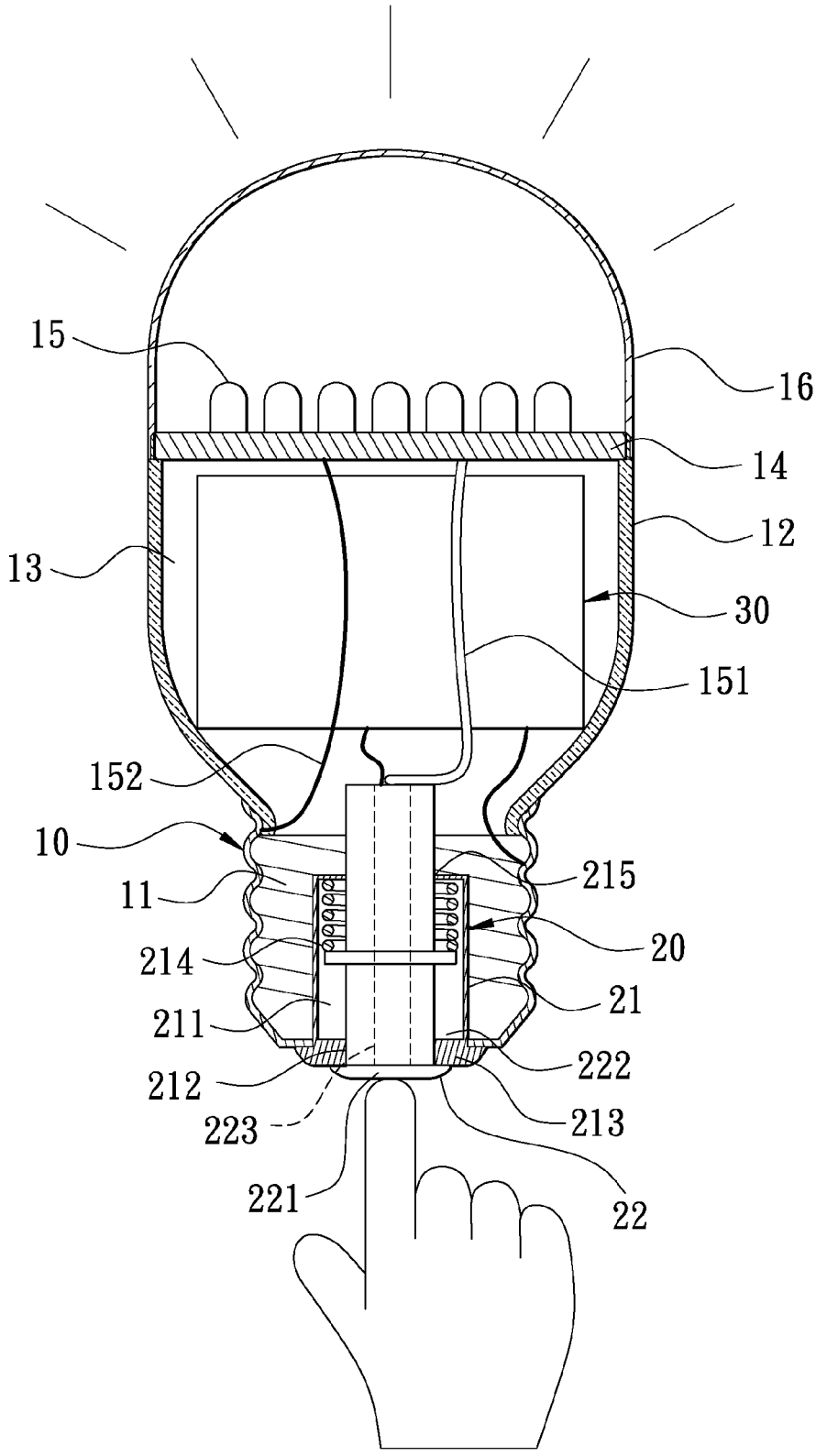
FIG. 6 is a schematic view illustrating the other service state of the lamp bulb according to this invention.

Refer to FIGS. 4 and 6 respectively shown as a block diagram of the circuit of a power unit according to this invention and as the other service state of a lamp bulb according to this invention. When the LED is used, the push portion 221 may be pushed with a finger to push the push unit 22 to stretch towards the lamp burner 10, and drive the electrically conductive portion 223 to contact the first pin 151, thereby a turn-on loop being formed. The microprocessor unit 32 enable the drive unit 34 to run, and the rechargeable battery 33 is used to drive the LED 15 to light up. Next, when the LED 15 is not used, the push portion is released from the finger only, and with the elastic part 214 that stays close to push, the switch device 20 is made to return to a portion where the electrically conductive portion 223 does not contact the first pin 151 for fear of power waste.

Figure 7:
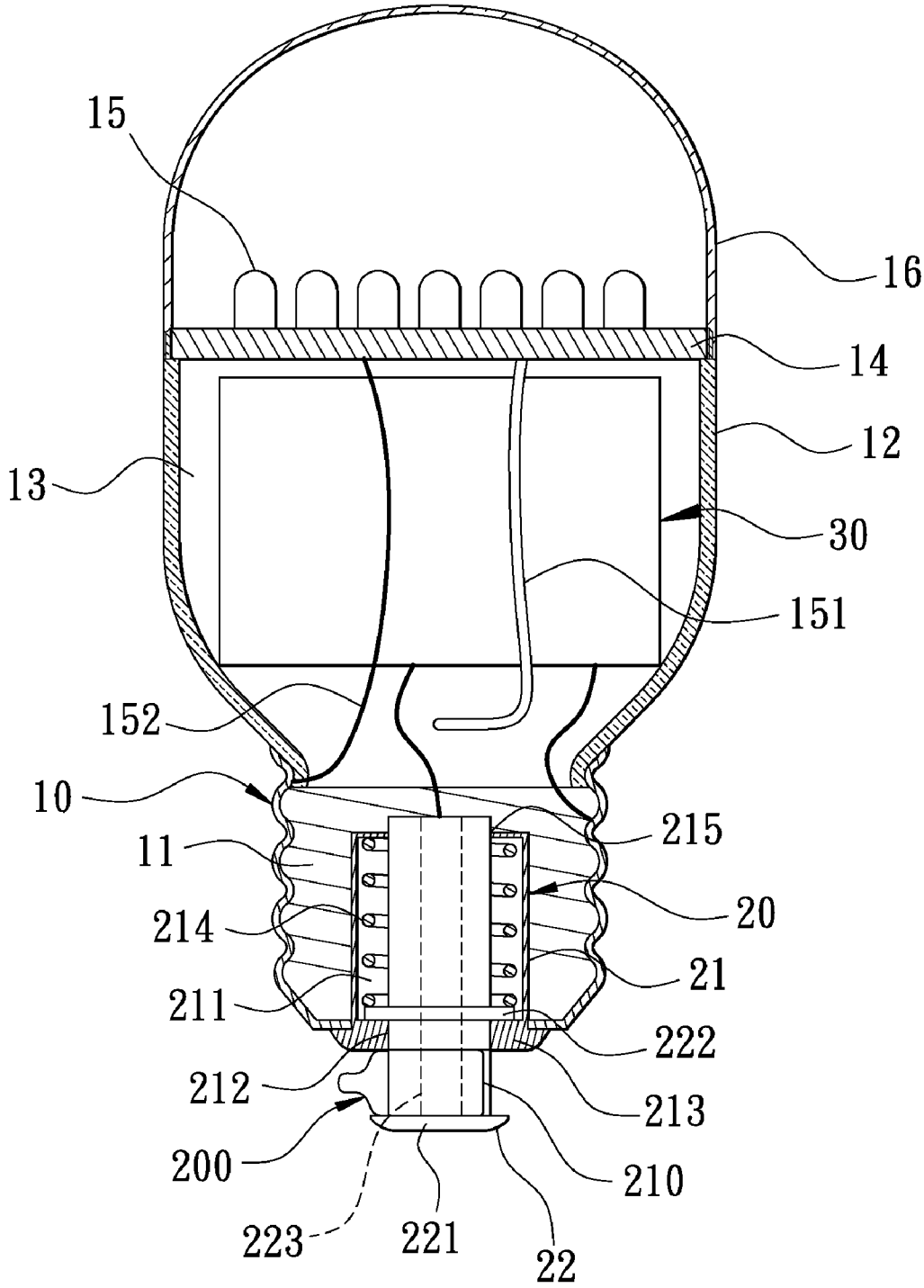
FIG. 7 is a schematic view illustrating a ring unit according to this invention that is set around a push portion.

Refer to FIGS. 4 and 7 respectively shown as a block diagram of the circuit of the power unit according to this invention and as a schematic view illustrating a ring unit according to this invention that is set around the push portion. A ring unit 200 may be set around between the push portion 221 and he wedge flange 213. The ring part 200 is a C-shaped elastic ring, a predetermined position of which is formed with a long mouth 201, and the ring part 200 is set from the mouth 201 around the outer circumferential wall of push unit 22 and fixed between the wedge flange 213 and the push portion 221 so that the push unit 22 may be fixed and cannot be squeezed to touch the first pin 151 to form a turn-on loop that makes the power of rechargeable battery 33 consume because colliding and swinging and swaying during delivery.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A lamp bulb provided with a lamp burner switch, comprising a plurality of LEDs that are provided on a substrate and further connected to a lamp burner, each of the LEDs being provided with a first pin and a second pin that is connected to the lamp burner inside which a chamber is formed, being characterized in that:

a switch device is provided passing through the crest of lamp burner at a side opposite to the LED, in which one terminal of the switch device is connected to a lamp socket and the other terminal is properly kept at an interval from the first pin of LED, and when being moved, the switch device is made to shift towards the chamber, and when contacting the first pin, the switch device makes the LED form a turn-on loop;

the switch device comprises a recovery unit and a push unit, in which the recovery unit passes through the chamber from the crest of lamp burner and is a cylinder and is provided with a room where a mouth is defined, a thru hole is provided passing through the bottom side of recovery unit, a wedge flange is provided in a radial direction around the mouth, the wedge flange is wedged to the top of lamp burner, an elastic part is further provided in the room, and the elastic part is wedged between the wedge flange of recovery unit and the bottom of room; and the push unit passes through the room from the mouth and through the thru hole, a push portion is formed in a radial direction around the top of push unit, the push portion is wedged to the wedge flange, a flange that is arranged in the room is formed on the outer circumferential wall of push unit, the flange is formed at the top of elastic part, an electrically conductive portion is vertically formed in the center of push unit, one terminal of the electrically conductive portion is connected to the lamp socket, and the other terminal is properly kept at an interval from the first pin of LED.

2. The lamp bulb provided with the lamp burner switch according to claim 1, wherein, a joint mask that crooks stretches upwards along the lamp burner, a container portion that communicates with the chamber is formed in the joint mask, a substrate is fixed onto a mouth above the container portion, and a plurality of LEDs are provided on the substrate and a lamp cap is provided to cover the substrate and wrap around the LED.

3. The lamp bulb provided with the lamp burner switch according to claim 2, wherein the lamp bulb further comprises a power unit that is provided in the chamber of lamp burner, in which one terminal of the unit is connected to the lamp burner and the other terminal is connected to the electrically conductive portion of push unit.

4. The lamp bulb provided with the lamp burner switch according to claim 3, wherein the power unit comprises a power processing unit, a microprocessor unit, a rechargeable battery, and a drive unit, in which one terminal of the power processing unit is connected to the electrically conductive portion and the other terminal is connected to the microprocessor unit, the microprocessor unit is connected to the rechargeable battery and the drive unit, respectively, the rechargeable battery is also connected to the drive unit, and the drive unit is further connected to the lamp burner.

* * * * *